United States Patent [19]

Johnson

[11] 4,236,160

[45] Nov. 25, 1980

[54] LOOP DRIVEN ELEMENT ANTENNA SYSTEM AND VOLTAGE FEED SYSTEM

[76] Inventor: Gregory F. Johnson, 1931 Seascape Blvd., Aptos, Calif. 95003

[21] Appl. No.: 949,856

[22] Filed: Oct. 10, 1978

[51] Int. Cl.[3] ..... H01Q 11/14

[52] U.S. Cl. ..... 343/743; 343/742; 343/867

[58] Field of Search ..... 343/741, 742, 743, 744, 343/866, 867, 749

[56] References Cited

U.S. PATENT DOCUMENTS

| | | | |
|---|---|---|---|
| 3,660,848 | 5/1972 | Kerch | 343/749 |
| 3,971,031 | 7/1976 | Burke | 343/750 |
| 4,138,682 | 2/1979 | Doherty | 343/742 |

FOREIGN PATENT DOCUMENTS

| | | | |
|---|---|---|---|
| 850974 | 10/1960 | United Kingdom | 343/742 |

OTHER PUBLICATIONS

McCloud, C. J., "Switched Polarization Cubical Quad" Radio Communication Jul. 1975, p. 533.

Adolph, E. H., "An Interlaced Quad Array for 50 & 144 MC" In QST, Feb. 1963, pp. 11–14.

*Primary Examiner*—David K. Moore

*Attorney, Agent, or Firm*—Limbach, Limbach & Sutton

[57] ABSTRACT

A system particularly useful for feeding antennas employing one electrical wavelength closed loop driven elements. Single or dual wire transmission line sections provide impedance match between the high voltage, high impedance feed point on the loop and a low impedance antenna feed line. Selectable polarization with high isolation between feed lines is provided by the connection of a second transmission line section to a point located 90 electrical degrees away on the loop, at the current maximum when the other feed point is excited.

37 Claims, 6 Drawing Figures

LOOP DRIVEN ELEMENT ANTENNA SYSTEM AND VOLTAGE FEED SYSTEM

BACKGROUND OF THE INVENTION

The invention relates to antennas and antenna feed systems and more particularly to a system in which a one electrical wavelength closed loop is voltage fed and matched to a low impedance feed line.

In order to transfer energy between a feed line and an antenna, typically some means is required to match or transform the antenna feed point impedance to the feed line characteristic impedance. Ideally, the matched antenna feed point should present a resistive, non-reactive impedance equal to the feed line characteristic impedance. Traditionally, most antennas having yagi type or loop type (the latter often referred to as "quad" antennas if square or diamond configured loops or as a "delta loop" if triangularly configured) have been fed by electrically opening the driven element so as to provide a current feed to a relatively low impedance point in conjunction with one of various types of matching devices (i.e., gamma match, stub match, inductive match, hairpin match, etc.). However, voltage feed for such antennas has not been popular due largely to the problems resulting from the requirement to handle high voltage (often in difficult environmental conditions) and the requirement to match the high impedance feed point to a relatively low impedance feed line.

Generally, voltage feed has been employed mainly in connection with antenna systems in which current feed is not reasonably possible, such as in feeding a long wire antenna.

In one prior art antenna system devised by the present inventor voltage feed to a one wavelength loop type antenna was achieved by means of a parallel resonant LC (inductor-capacitor) circuit having its high impedance point connected to the loop and being fed from a low impedance transmission line by means of an inductive link coupling to the resonant circuit inductor. The system was found to be susceptible to high voltage damage and was found to be difficult to adequately weatherproof.

SUMMARY OF THE INVENTION

In accordance with the teachings of the present invention a loop driven element antenna system and loop driven element antenna feed system is provided having a novel voltage feed. Said invention overcomes the problems heretofore encountered in voltage feed and further provides for a loop driven element antenna feed system in which dual polarization is achieved with high isolation between feed points. Further, the invention provides for the voltage feeding of multi-frequency antenna employing multiple driven element loops contained in a single plane. These and other advantages of the present invention will be further appreciated as the detailed description is read in connection with the drawings.

DETAILED DESCRIPTION OF THE PREFERRED EMBODIMENTS

Figure 1:
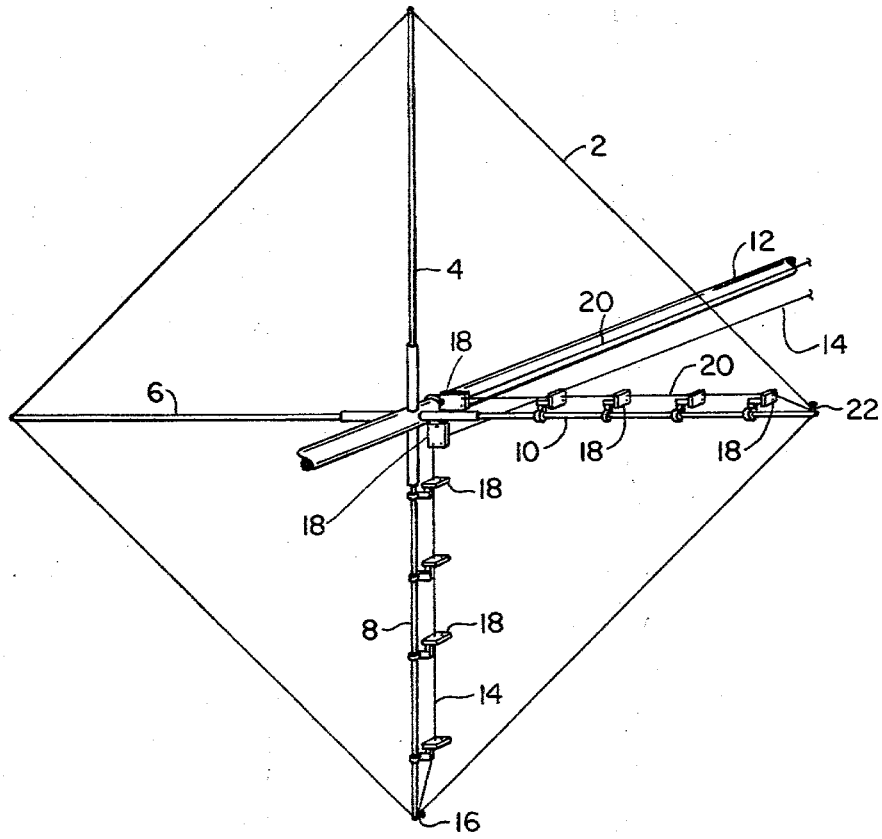
FIG. 1 is a broken away perspective view of a portion of a multi-element antenna array incorporating the present invention.

Referring now to the drawings and particularly to FIG. 1, the driven element of a multi-element antenna array is shown generally to include a closed loop 2 (i.e., electrically continuous with no break or opening) having a length of substantially one electrical wavelength at the desired operating frequency of the antenna, support arms 4, 6, 8 and 10 and a broken away metal support boom 12 on which parasitic elements are supported.

Figure 7:
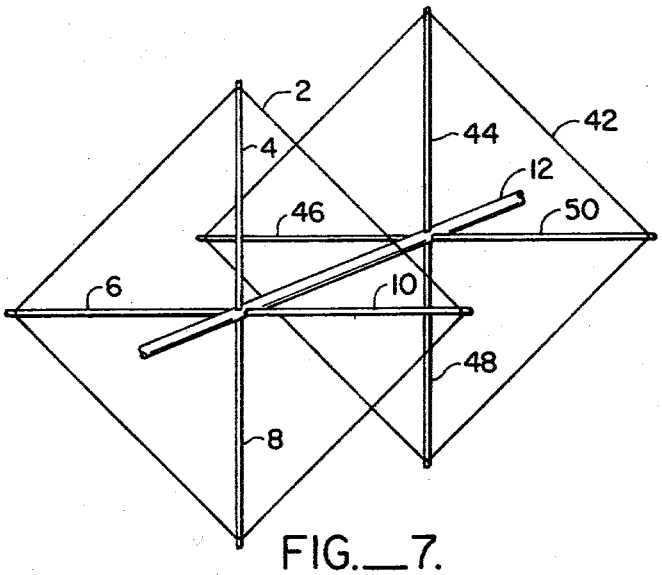

Multi-element parasitic arrays of the loop type and yagi type and combination loop/yagi type are well-known in the art and for simplicity the parasitic elements are not shown, except generally in FIG. 7 which also shows a parasitic loop 42 on support arms 44, 46, 48 and 50.

Preferably the support arms 4, 6, 8 and 10 are nonconductive or if conductive, are broken up by insulator segments to minimize affects upon the loop 2.

A first single wire high impedance transmission line section 14 has one of its ends connected to a point 16 on the loop 2. By carefully selecting the attachment points one can cause the antenna to exhibit particular polarizations. Because the loop 2 wire 14 is open circuited at its far end is continuous, any point on the loop presents the same characteristic high voltage, high impedance values. Wire 14 has a total length in the order of 0.23 to 0.38 wavelengths of the loop resonant frequency. Wire 14 is held away from arm 8 by plastic insulators 18 mounted to arm 8 and to boom 12. When non-conductive (such as fiberglass) support arms are used no insulators are required on the support arms unless required for mechanical stability. The wire 14 acts essentially as a quarter wave matching stub, however, a length greater than a quarter wavelength is required in practice to cancel reactance possibly arising from the fact that wire 14 runs parallel to the conductive boom 12 for only a portion of its length.

A second single wire high impedance transmission line section 20 has one of its ends connected to a point 22 on the loop 2. Wire 20 is also open circuited at its far end while this point is an identical high voltage feed point and presents the same high impedance as point 16, it is located at a current maximum, ninety degrees away relative to point 16 and vice-versa, thus the two points are well isolated electrically. Feed at either point 16 and 22 results in different antenna polarization. If point 16 is closest to the reflecting ground plane (the earth) then feed at point 16 results in vertical polarization. Wire 20 has the same length as wire 14 and is also mounted on plastic insulators 18.

Figure 2:
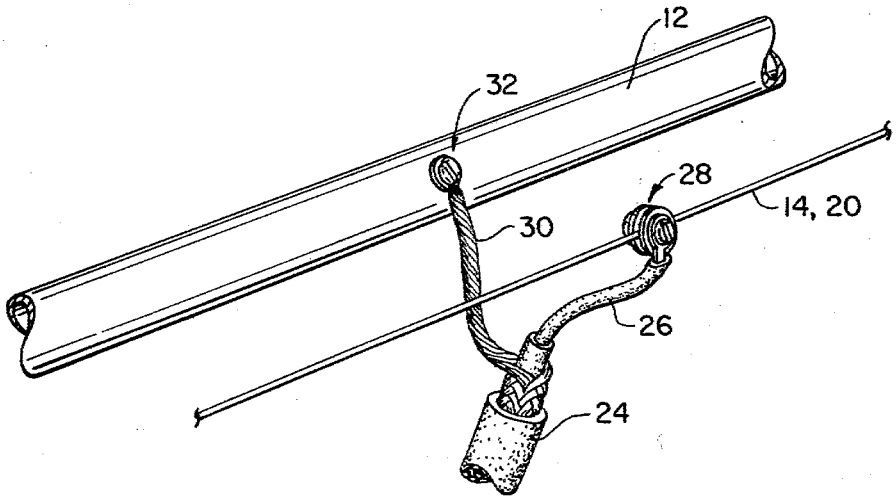
FIG. 2 is a broken away perspective view showing the feed line connection to the antenna of FIG. 1.

FIG. 2 shows the manner in which an unbalanced coaxial transmission feed line 24 is connected to wires 14 or 20 and the ground reference boom 12. The feed line 24 connection is not shown in FIG. 1 for simplicity. The inner conductor 26 of feed line 24 is connected to the wire 14 or 20 (separate feed lines are connected to each wire 14 and 20) by suitable means such as by screw, washers, lug and nut shown generally at 28. The outer conductor or braid 30 of the feed line 24 is connected to the metal boom 12 by suitable means such as by an easily-moved clamp or strap to facilitate adjusting the point of attachment for V.S.W.R. optimization or by lug and self-tapping screw shown generally at 32 for a more permanent connection when the optimum point of attachment has been determined. Connection is made to the boom 12 directly opposite the connection to the wire 14, 20 connection. By trial and error an optimum connection point along wire 14 or 20 can be determined, the exact point depending on the feedline impedance and other physical parameters. Techniques of impedance measurement suitable for determining the optimum connection are simple and well-known in the art. Similarly, the optimum length of the wire 14 or 20 can be determined by trial and error, although a length in the order of 0.31λ has been found suitable. An excellent match to 52 ohm coaxial cable (V.S.W.R. below 1.2–1 over a 1% bandwidth) has been achieved for a two element quad (i.e., one driven element, one parasitic element).

Figure 3:
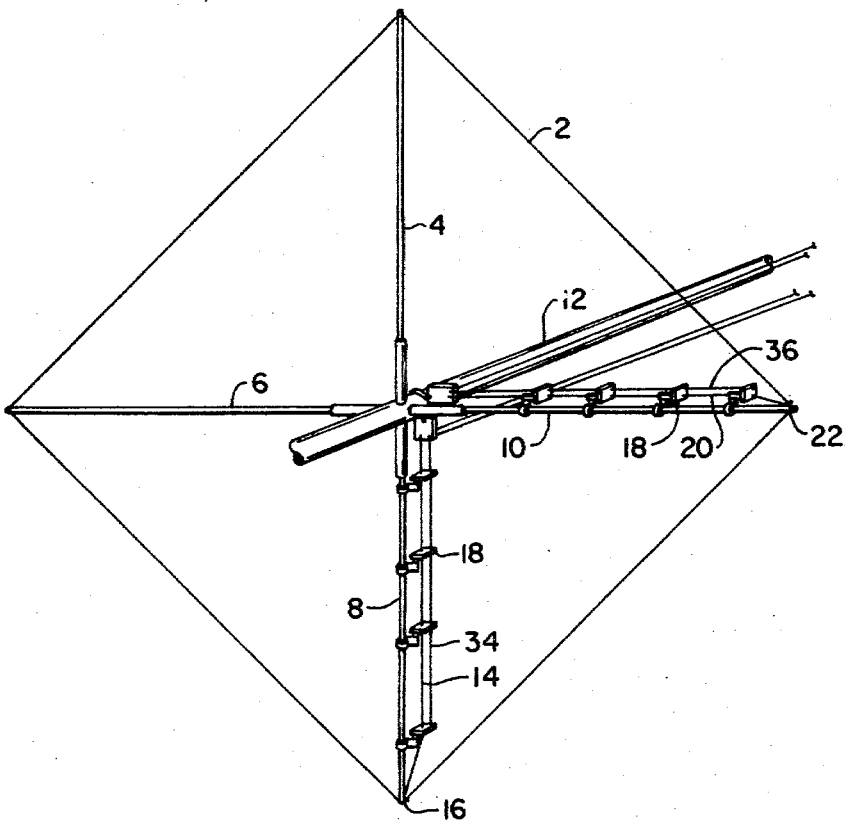
FIG. 3 is a broken away perspective view showing a modification of the system of FIG. 1.
Figure 4:
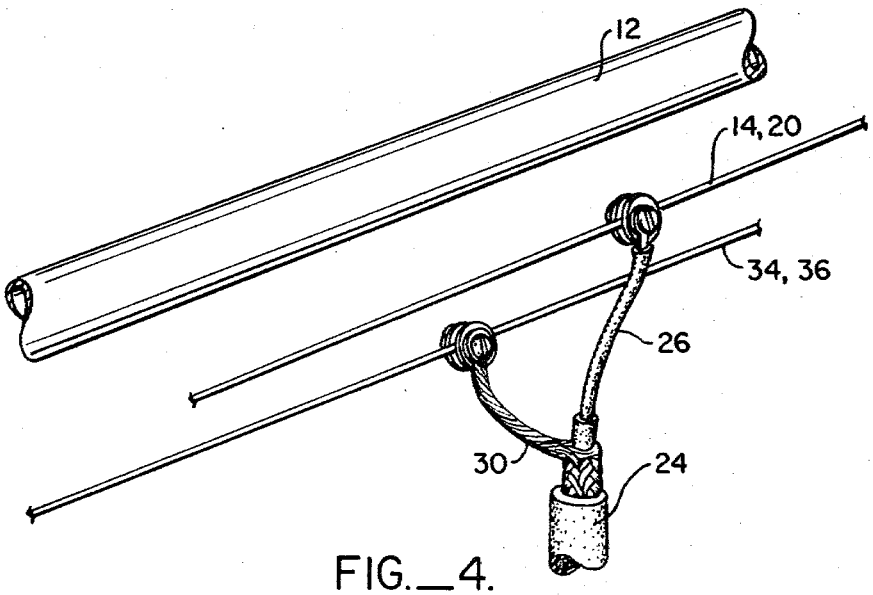
FIG. 4 is a broken away perspective view showing the feed line connection to the antenna of FIG. 3.

In FIGS. 3 and 4, a modification of the system of FIGS. 1 and 2 is shown. Throughout the driving figures of like elements will retain the same reference numeral. In the modified system of these figures, a second wire 34 and 36 is run parallel to wires 14 and 20, respectively, to act as a ground for the wires 14 and 20 to work against in lieu of the metal boom 12. Consequently, the braid or outer conductor 30 of feed line 24 is connected to wire 34 or 36 instead of to the metal boom 12 in the vicinity of the connection to wire 14 or 20. It has been found that the coax braid is preferably connected to the stub wire that is open at both ends, however, the system does work (although the V.S.W.R. is higher) when the braid and center conductor connections are reversed. Wires 34 and 36 are also held by insulators 18, are open circuited at both ends and have the same length as wires 14 and 20, except for the short length of wires 14 and 20 from the closest insulator 18 to points 16 and 22, respectively. It has been found that in the case of the parallel wire configuration of FIGS. 3 and 4, that the length of each wire is optimally substantially one quarter wavelength of the loop resonant frequency.

Figure 5:
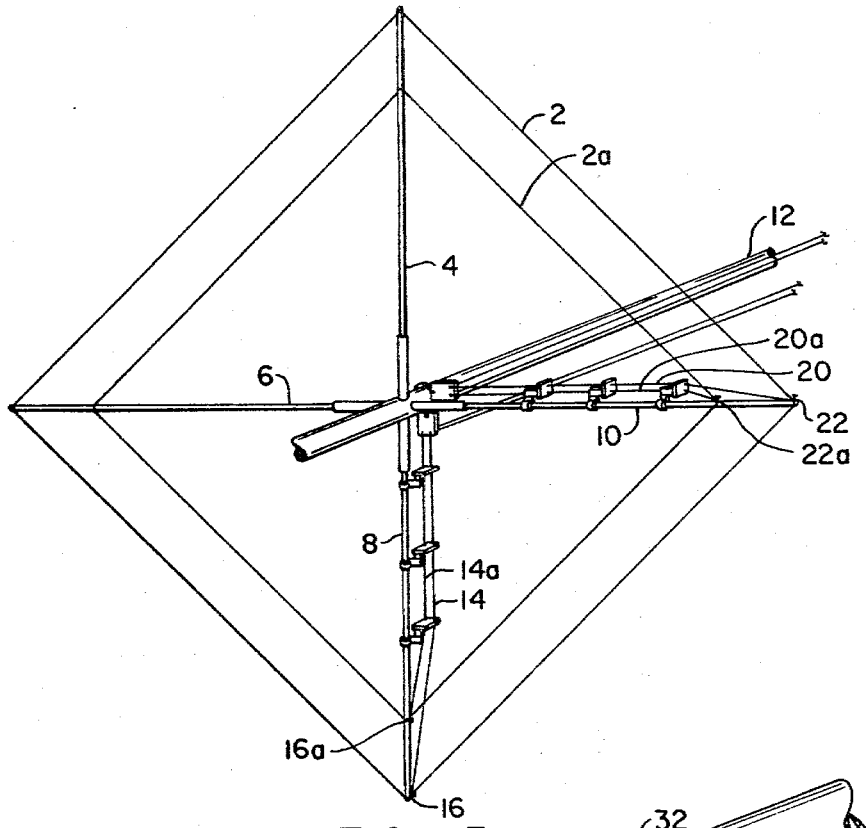
FIG. 5 is a broken away perspective view of a further modification of the system of FIG. 1.
Figure 6:
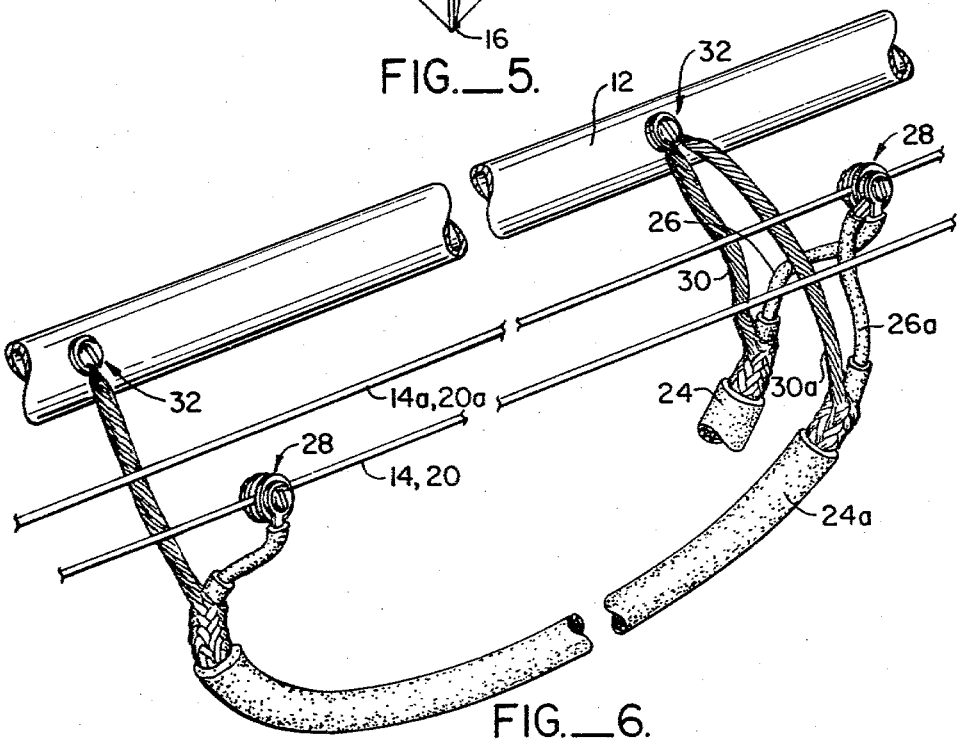
FIG. 6 is a broken away perspective view showing the feed line connection to the antenna of FIG. 5.

In FIGS. 5 and 6 the invention is shown in connection with a multi-frequency antenna. A second closed loop **2*a* is supported within loop 2, in the same plane as loop 2. Because loop 2*a* has a different length, it consequently has a different resonant frequency. Additional loops having different resonant frequencies can be located on the same support arms 4, 6, 8 and 10. Amateur radio antennas having as many as four concentric driven element loops are known for use on four frequency separated amateur bands. Additional single matching wires 14*a* and 20*a* are provided to the loop 2*a* in the manner of the FIG. 1 embodiment. A single feed line to the antenna can be provided by connecting the feed line 24 to the optimum feed point for one of the loops such as loop 2*a* and by connecting in parallel a half-wavelength (at the frequency of the other loop) of feed line to the optimum feed point of the other loop as shown in FIG. 6. If further loops are being fed, half wave loops continue to connect in the same manner. The wires 14 and 20 will be of a longer length than the wires 14*a* and 20*a* because they are used in connection with the lower frequency loop. Alternately, dual wire matching lines of the configuration shown in FIGS. 3 and 4 can be employed with multi-frequency loop antennas but have not been shown to maintain simplicity in the drawings. The half-wavelength feedline in FIG. 6 is identified as 24*a*, having an inner conductor 26*a* and braid 30*a***.

Figure 8:
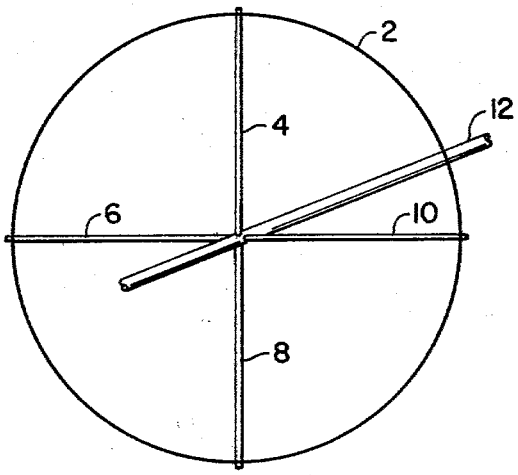
Figure 9:
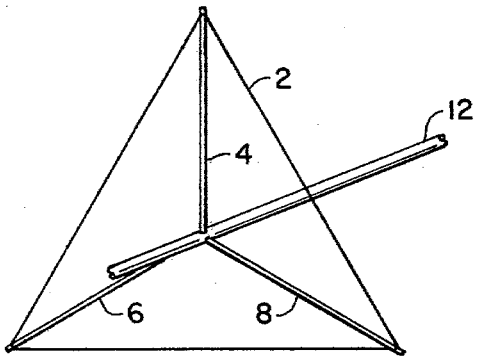

If desired, a single feed point to the loop may be employed instead of dual feed, in which case there is no choice of polarization by selecting feed lines. Also, a so-called square loop configuration can be used in which the loop is, in effect, rotated 45 degrees in the drawings so that two sides of the loop are parallel to the ground and two are vertical. In that case, the feed wires are connected to the mid-points of adjacent sides. The feed system is applicable to any loop configuration including circular, triangular (delta), etc. FIG. 8 shows generally a circular loop configuration and FIG. 9 shows generally a triangular or delta loop configuration. Also, it will be understood that a single driven element loop can be employed without parasitic elements and, alternately, that more than one loop can be employed simultaneously as a driven element.

In addition, circular polarization can be achieved by simultaneously feeding two points ninety degrees apart on a loop, such as by using the feedlines 24 connected to wires 14 and 20 of FIGS. 1 and 2. In such case, one of the feedlines 24 must have a ninety degree phase shift introduced into it by some suitable means (a quarter wave difference in length, a phasor, etc.).

I claim:

1. A feed system for antennas having a loop driven element comprising a single conductor high impedance transmission line operating against ground, one end of said transmission line connected to a point on said loop, the other end remaining open circuited, means for providing a ground for said transmission line to operate against, and means for connecting a low impedance dual conductor transmission line to a point along said single conductor transmission line and to said ground means, said point spaced a substantial distance along said single conductor transmission line from the connection of said single conductor transmission line to said loop.

2. The feed system of claim 1 wherein said ground means comprises a conductive antenna support member in proximity to at least a portion of said single conductor transmission line.

3. The feed system of claim 2 wherein said dual conductor transmission line has one conductor connected to a point on said single conductor transmission line and the other conductor connected to a point on said conductive antenna support member in the vicinity of said first recited connection.

4. The feed system of claim 3 wherein the point of connection is selected to substantially match the impedance of said dual conductor transmission line.

5. The feed system of claim 4 wherein said dual conductor transmission line is a coaxial transmission line having a single center conductor and an outer conductor and wherein the center conductor is connected to said single conductor transmission line and the outer conductor is connected to said conductive support member.

6. The feed system of claim 1 wherein said ground means comprises a further single conductor spaced from and running parallel to said single conductor transmission line, said single conductors having substantially the same length.

7. The feed system of claim 6 wherein said dual conductor transmission line has one conductor connected to one of a point on said single conductor transmission line and a point on said further wire in the vicinity of said first recited connection and the other conductor connected to a point on the other of said conductors.

8. The feed system of claim 7 wherein the point of connection is selected to substantially match the impedance of said dual conductor transmission line.

9. The feed system of claim 8 wherein said dual conductor transmission line is a coaxial transmission line having a single center conductor and an outer conductor and wherein the center conductor is connected to said single conductor transmission line and the outer connector is connected to said other single conductor.

10. The feed system of claim 6 wherein said loop driven element is a closed one electrical wavelength loop and the length of said conductors is in the order of one quarter of the loop electrical wavelength.

11. The feed system of claim 1 wherein said loop driven element is a closed one electrical wavelength loop and the length of said single conductor transmission line is in the range of 0.23 to 0.38 of the loop electrical wavelength.

12. The feed system of claim 1 further comprising a second single conductor high impedance transmission line operating against ground, one end of said second single conductor transmission line connected to a point on said loop ninety electrical degrees away from the point of connection of said first single conductor transmission line to said loop, the other end of said second single conductor transmission line remaining open circuited, said ground means further providing a ground for said second transmission line to operate against, and means for connecting a further low impedance dual conductor transmission line to a point on said second single conductor transmission line and to said ground means.

13. The feed system of claim 12 wherein said ground means comprises a conductive antenna support member in proximity to at least a portion of each of said single conductor transmission lines.

14. The feed system of claim 13 wherein each of said dual conductor transmission lines has one conductor connected to a point on a respective one of said single conductor transmission lines and the other conductor connected to a point on said conductive antenna support member in the vicinity of said first recited connections.

15. The feed system of claim 14 wherein the points of connection are selected to substantially match the impedance of said dual conductor transmission lines.

16. The feed system of claim 15 wherein said dual conductor transmission lines are coaxial transmission lines each having a single center conductor and an outer conductor and wherein the center conductors are connected to respective ones of said single wire transmission lines and the outer conductors are connected to said conductive support member.

17. The feed system of claim 12 wherein said ground means comprises further single conductor spaced from and running parallel to each of said single conductor transmission lines, all of said single conductors having substantially the same length.

18. The feed system of claim 17 wherein each of said dual conductor transmission lines has one conductor connected to a point on a respective one of said single conductor transmission lines and the other conductor connected to a point on the other of said respective single conductors.

19. The feed system of claim 12 wherein said loop driven element is a closed one electrical wavelength loop and the length of said single conductor transmission line is in the range of 0.23 to 0.38 of the loop electrical wavelength.

20. The feed system of claim 17 wherein said loop driven element is a closed one electrical wavelength loop and the length of said conductors is in the order of one quarter of the loop electrical wavelength.

21. The feed system of claim 1 wherein said loop is configured as a diamond and the point of connection to the loop is at one of the corners thereof.

22. The feed system of claim 1 wherein said loop is configured as a square and the point of connection to the loop is substantially at the mid-point of one of the sides thereof.

23. The feed system of claim 1 wherein said loop is configured as a circle.

24. The feed system of claim 1 wherein said loop is configured as a triangle.

25. The feed system of claim 12 wherein said loop is configured as a diamond and the points of connection to the loop are at adjacent corners thereof.

26. The feed system of claim 12 wherein said loop is configured as a square and the points of connection to the loop are substantially at the mid-points of adjacent sides thereof.

27. The feed system of claim 1 wherein said loop driven element is a closed one electrical wavelength loop.

28. The feed system of claim 12 wherein both said first recited and further low impedance transmission lines are simultaneously fed, one of said low impedance transmission lines having a ninety degree phase shift relative to the other, whereby the antenna has a circular polarization characteristic.

29. An antenna system comprising a loop driven element, a single conductor high impedance transmission line operating against ground, one end of said transmission line connected to a point on said loop, the other end remaining open circuited, means for providing a ground for said transmission line to operate against, and means for connecting a low impedance dual conductor transmission line to a point along said single conductor transmission line and to said ground means, said point spaced a substantial distance along said single conductor transmission line from the connection of said single conductor transmission line to said loop.

30. The antenna system of claim 29 further comprising a second single conductor high impedance transmission line operating against ground, one end of said transmission line connected to a point on said loop ninety electrical degrees away from the point of connection of said first single conductor transmission line to said loop, the other end of said second single conductor transmission line remaining open circuited, said ground means further providing a ground for said second transmission line to operate against, and means for connecting a further low impedance dual conductor transmission line to a point on said second single conductor transmission line and to said ground means, whereby selectable polarization is provided by selection of said dual conductor transmission lines.

31. The antenna system of claim 30 wherein said loop is configured as a diamond and wherein said points of connection to said loop are at adjacent corners of said loop.

32. The antenna system of claim 31 further comprising at least one parasitic element operating with said driven element.

33. The antenna system of claim 30 further comprising at least one parasitic element operating with said driven element.

34. The antenna system of claim 30 wherein each of said loop driven elements is a closed one electrical wavelength at the respective resonant frequencies.

35. The antenna system of claim 29 further comprising at least one parasitic element operating with said driven element.

36. The antenna system of claim 29 comprising at least one further loop driven element, each of said loops lying in substantially the same plane and having different resonant frequencies, at least one further single conductor high impedance transmission line operating against ground, each of said transmission lines having one end connected to a point on a respective one of said loops and having its remaining end open circuited, said ground means providing a ground for all of said transmission lines to operate against, and wherein said means for connecting said low impedance dual conductor transmission line to a point on said single conductor transmission line and to said ground means further includes means for connecting said dual conductor transmission line to a point on each of the respective single conductor transmission lines and to said ground means, said means including a half wavelength of said dual conductor transmission line connected from the connection point and ground means connection of one loop to the connection point and ground means of the other loop, said half wavelength being substantially at the frequency of the loop to which the low impedance transmission line is not directly connected.

37. The antenna system of claim 29 wherein said loop driven element is a closed one electrical wavelength loop.

* * * * *

UNITED STATES PATENT AND TRADEMARK OFFICE

CERTIFICATE OF CORRECTION

PATENT NO. : 4,236,160

DATED : Nov. 25, 1980

INVENTOR(S) : Gregory F. Johnson

It is certified that error appears in the above-identified patent and that said Letters Patent are hereby corrected as shown below:

Column 2, line 32, insert --wire 14 is open circuited at its far end--.

Column 2, lines 34 and 35, delete "wire 14 is open circuited at its far end".

Column 2, line 52, insert a period after "end" and capitalize "while".

Claim 9, line 15, delete "connector" and substitute --conductor--.

Claim 17, line 2, make "conductor" plural.

Signed and Sealed this

*Seventeenth* Day of *March 1981*

[SEAL]

*Attest:*

RENE D. TEGTMEYER

*Attesting Officer* *Acting Commissioner of Patents and Trademarks*